US006255993B1

(12) United States Patent
Greeff et al.

(10) Patent No.: US 6,255,993 B1
(45) **Date of Patent: *Jul. 3, 2001**

(54) RIGHT AND LEFT HAND CIRCULARLY POLARIZED RFID BACKSCATTER ANTENNA

(75) Inventors: Roy Greeff, Boise; David K. Ovard, Meridian; Dirgha Khatri, Boise, all of ID (US)

(73) Assignee: Micron Technology, Inc., Boise, ID (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/349,615

(22) Filed: Jul. 8, 1999

(51) Int. Cl.[7] ..... H01Q 3/02
(52) U.S. Cl. ..... 343/700 MS; 343/860
(58) Field of Search ..... 343/700 MS, 756, 343/795, 890, 731, 850, 860, 864; 342/365, 361, 373; 455/562, 101, 132, 272

(56) References Cited

U.S. PATENT DOCUMENTS 3,827,051 * 7/1974 Foldes ..... 343/176
4,926,187 * 5/1990 Sugawara et al. ..... 342/361
5,038,150 * 8/1991 Bains ..... 342/373
5,504,493 * 4/1996 Hirshfield ..... 342/372
5,966,102 * 10/1999 Runyon ..... 343/820
5,969,681 * 10/1999 O'Neill, Jr. ..... 343/700 MS
5,982,326 * 11/1999 Chow et al. ..... 342/365
6,150,994 * 11/2000 Winter et al. ..... 343/895

* cited by examiner

*Primary Examiner*—Don Wong
*Assistant Examiner*—Chuc D. Tran
(74) *Attorney, Agent, or Firm*—Wells, St. John, Roberts, Gregory & Matkin P.S.

(57) ABSTRACT

An antenna, system and method for transmitting and receiving RF signals over a first frequency band using a single antenna or two closely spaced antennas. In one embodiment, the antenna is configured to receive first signals in the first frequency band having a first rotational polarization and to transmit second signals in the first frequency band and having a second rotational polarization. The second signals may be transmitted in response to the first signals. The first signals may be preferentially routed to a receiver using signal conditioning circuitry that also routes the second signals from a transmitter to the antenna but not to the receiver.

33 Claims, 2 Drawing Sheets

RIGHT AND LEFT HAND CIRCULARLY POLARIZED RFID BACKSCATTER ANTENNA

TECHNICAL FIELD

This invention pertains to an antenna that separates transmitted and received signals having a common frequency.

BACKGROUND OF THE INVENTION

A prior art system 10 for interrogating one or more radio frequency transponding modules 12 is described with reference to FIG. 1. The system 10 includes an interrogator 13 operating in response to commands from a controller 14. Data and commands are exchanged between the interrogator 13 and the controller 14 through interconnections 15.

In one mode of operation, a transmitter TX 16 contained in the interrogator 14 supplies RF signals through interconnections 17 to a transmit/receive (T/R) antenna system 18. The T/R antenna system 18 in turn radiates an interrogation signal 20 to one or more of the transponding modules 12. When the interrogation signal 20 is received by one of the transponding modules 12, a response signal 24 may be generated and transmitted. The response signal 24 typically includes modulation allowing some property or set of properties of the transponding module 12 to be determined.

The response signal 24 is received by the antenna system 18 and is coupled to a receiver RX 28. The receiver RX 28 demodulates the received response signal 24 and supplies information determined from the received response signal 24 to the controller 14 via the interconnections 15. The controller 14, in turn, may be able to supply information derived from the response signal 24 to an external processor (not illustrated) via a bus or other data link 30.

Systems such as the system 10 find wide-ranging application in a broad variety of settings. The IPASS toll collection system presently in use in the Chicago area is one example of such a system. In transponder-based toll collection systems, the presence of an object, such as a moving vehicle (not illustrated), is detected by a detector. In a toll collection system, the detection process may rely on reflection of electromagnetic waves, detection of magnetic anomalies or detection of a large mass.

In response to detection of the presence of the vehicle, the controller 14 causes the transmitter TX 16 to transmit interrogation signals 20 having carefully limited range. The transponding module 12 is typically a dash-mounted unit that has been pre-programmed to identify the vehicle and to provide information regarding a pre-existing account associated with that vehicle.

The transponding module 12 transmits a response signal 24 containing information to the interrogator 13. The information in the response signal 24 identifies the vehicle and the account associated with that transponding module 12. The receiver RX 28 receives the response signal 24, demodulates this information and couples the received information to the controller 14. The controller 14 may pass the received information to one or more computers (not shown) via the data link 30, causing the account associated with the vehicle to be appropriately decremented. As a result, the vehicle need not slow for the toll collection process, providing smoother traffic flow, reducing fuel consumption and generally facilitating both vehicular transportation and toll collection.

Similarly, an automated fuel retail system (not illustrated) may use the system 10 including the interrogator 13. The interrogator 13 exchanges signals with the transponder 12 that is attached to vehicle (not illustrated) to determine whom to bill for fuel dispensed to that vehicle when the vehicle is fueled at the fuel dispensing station.

In these kinds of systems 10, a range of the interrogation signal 20 is carefully limited to avoid interrogation of more than one transponding module 12 at a time. Additionally, it is often desirable to limit the amount of power that is required by the transponding module 12 in order to provide a stand-alone transponding module 12 that is able to operate without requiring an external source of power and that has long battery life.

Further, it is generally desirable to provide systems 10 that are as simple as possible. One approach to realizing these goals is to receive and transmit the interrogation 20 and response 24 signals in a common frequency band. In some systems, the response signals 24 are derived from the interrogation signals 20 and the transponding module 12 may even be one that simply modulates and re-transmits the received interrogation signal 20 to provide the response signal 24.

One simple technique for modulating the interrogation signal 20 to form the response signal 24 is to either (i) forward bias a diode that is coupled across an antenna in the transponding module 12, corresponding to a first logical state, or (ii) to leave the diode unbiased or reverse biased, corresponding to a second logical state. The transponding module 12 repeatedly switches between these two logical states according to predetermined patterns while the interrogation signal 20 is present to modulate the response signal 24 with a binary signal. These kinds of systems 10 are known as backscatter systems.

In some backscatter systems, the interrogation signal 20 includes a modulated preamble that carries data identifying which transponding module 12 in a population of such transponding modules 12 is targeted to respond. The preamble of the interrogation signal 20 further may include a request for specific data from the targeted transponding module 12. In such backscatter systems, the interrogation 20 and reply 24 signals must necessarily use the same frequency band and both the interrogation 20 and response 24 signals are present at the same time.

Systems 10 that simultaneously or contemporaneously transmit interrogation signals 20 and receive response signals 24 having common frequencies using a common antenna or closely spaced transmit and receive antennas for the T/R antenna system 18 often include some sort of component for separating the transmitted interrogation 20 and received response 24 signals. These systems 10 must particularly ensure that the transmitted interrogation signal 20 does not feed directly into the receiver RX 28.

For example, circulators (not illustrated) are employed in some types of systems where a single antenna is used for both transmission and reception of signals in a common frequency band. Circulators typically have three or more ports, and have the property that each port is strongly coupled to one of the two adjacent ports (referred to as forward coupling) but is not strongly coupled to the other of the two adjacent ports (referred to as reverse isolation).

However, circulators tend to be somewhat bulky, include a large permanent magnet and provide limited reverse isolation. For example, an antenna that is matched to provide a VSWR (voltage standing wave ratio) of 1.5:1 will provide a 20 dB return loss. When portions of transmitted signals are reflected from the antenna back into the circulator, an unacceptably large amount of RF energy may be coupled back into the receiver RX 28 from the transmitter TX 16.

Another approach for reducing unwanted coupling between the transmitter TX 16 and the receiver RX 28 is to employ separate transmitter and receiver antennas (not illustrated) in the antenna system 18. The receiver antenna is placed in or near a null in a radiation pattern associated with the transmitter antenna. Typically, the receiver antenna is placed somewhat behind the transmitter antenna.

One problem with this approach is that an object that reflects substantial portions of the interrogation signal 20 may pass through the radiation pattern of the transmitter antenna such that a large reflected interrogation signal 20 impinges on the receiver antenna. When such reflections occur, large undesired signals may be introduced into the receiver RX 28, causing the received RX 28 to fail to respond to weaker but desired signals.

Similar kinds of systems 10 are presently of great interest for identifying, sorting, counting and routing in situations where selected objects in a population of objects require individual recognition and treatment. Examples include luggage-handling and routing systems associated with public or private transportation systems, package handling and routing systems, vehicle or other rental or check-out systems and inventory control systems.

Some kinds of systems 10 may interrogate a large number of transponding modules 12 simultaneously. For example, an inventory control system may be used to determine if a specific item coupled to the target transponding module 12 is contained in a warehouse. Typically, each transponding module 12 is associated with an inventory item in the warehouse and vice versa.

In these types of systems, code division multiple access may be used to discriminate between responses from multiple transponding modules 12. Alternatively, a preamble including a code or serial number unique to the desired target transponding module 12 may be transmitted by the interrogator 13, and only the target transponding module 12 responds to the interrogation signal 20.

Other schemata include (i) transmitting interrogation signals 20 from the interrogator 13 to a group of responding target transponding modules 12, (ii) distinguishing some response signals 24 from the group of target transponding modules 12, (iii) transmitting signals from the interrogator 13 to turn those transponding modules 12 identified from the response signals 24 OFF, (iv) iterating steps (i)–(iii) until the desired target transponding module 12 has been identified and interrogated and then (v) transmitting signals from the interrogator 13 to restore the ensemble of transponding modules 12 to their initial status or any other desired status. Other methods for selecting one or more target transponding modules 12 in a population of transponding modules is known as well.

In all of these systems 10, it is generally desirable to reduce the complexity of the transponding modules 12 as much as is feasible without compromising the functions that the transponding modules 12 are intended to accomplish. One reason for this is that the system 10 may include a large number of transponding modules 12. Backscatter systems tend to employ very simple and compact transponding modules 12, but tend to have difficulty in ensuring that the interrogation signal 20 does not compromise performance of the receiver RX 28. This is particularly troublesome in backscatter systems because both signals are present in the same frequency band at the same time and because the transmitter and receiver antennas must be physically close to each other. Accordingly, it is helpful to reduce the amount of the interrogation signal 20 that impinges on the receiver RX 28.

SUMMARY OF THE INVENTION

In one aspect, the invention includes an antenna circuit for transmitting and receiving signals in a common frequency band and for separating the transmitted signals from the received signals. The antenna circuit comprises an antenna capable of coupling to radio waves having rotational polarization in the common frequency band, and a signal transmission path having a first end coupled to the antenna. The antenna circuit also includes a signal conditioning circuit having first and second ports coupled to a second end of the signal transmission path. The signal conditioning circuit couples first signals in the frequency band from an input port to the first and second ports and then through the signal transmission path to the antenna to transmit first radio waves from the antenna. The first radio waves have a first rotational polarization. Second radio waves that have a second polarization different than the first rotational polarization and that are also in the common frequency band impinge on and are received by the antenna to provide second signals. The second signals are coupled through the signal transmission path to the first and second ports to provide a signal at an output port of the signal conditioning circuit.

In another aspect, the invention includes an antenna circuit having a patch antenna capable of coupling to radio waves having right or left hand circular polarization, on their polarization, in a frequency band. A pair of quarter-wavelength transmission lines is coupled to the patch antenna. A first line of the pair has a first end coupled to a first edge of the patch antenna and a second line of the pair has a first end coupled to a second edge of the patch antenna adjacent the first edge. A quadrature hybrid coupler has a first port coupled to a second end of the first line and a second port, adjacent the first port, coupled to a second end of the second line. A phase shift of ninety degrees exists between any pair of adjacent ports of the quadrature hybrid coupler. As a first result, the quadrature hybrid coupler provides an output signal at an output port in response to first radio waves in the frequency band impinging on the patch antenna with a first polarization. As a second result, the quadrature hybrid coupler also causes the patch antenna to radiate second radio waves having a second polarization different than the first polarization when an input signal in the frequency band is coupled to an input port of the quadrature hybrid coupler.

In a further aspect, the invention includes a system for remotely polling transponding modules each associated with one or more objects. The system includes an interrogator having a transmitter for transmitting an interrogation signal having a first rotational polarization and a receiver for receiving a response signal having a second polarization. The system also includes at least one transponding module associated with a corresponding object. The interrogator comprises an antenna configured to couple to the interrogation and response signals and a signal conditioning circuit having first and second ports coupled to the antenna. The interrogator also includes a receiver coupled to an output port of the signal conditioning circuit. The signal conditioning circuit has an input port that couples the interrogation signal from the transmitter to the first and second ports and thus to the antenna. The signal conditioning circuit couples the response signal from antenna of the output port and thus to the receiver but does not couple the interrogation signal to the output port or to the receiver.

In yet another aspect, the invention includes an antenna system. The antenna system has an antenna for receiving a first signal having a first polarization in a frequency band.

Additionally, the antenna system comprises means for coupling the first signal to an output port and means for coupling a second signal in the frequency band from an input port to the antenna to radiate a second signal with a second rotational polarization different than the first polarization and not couple the second signal to the output port.

In a yet further aspect, the invention includes a method of operating an antenna. The method comprises transmitting, by an antenna, an interrogation signal in a frequency band, where the interrogation signal has a first rotational polarization. The method also comprises receiving, by the antenna, a response signal in the frequency band. The response signal has a second polarization different than the first rotational polarization.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
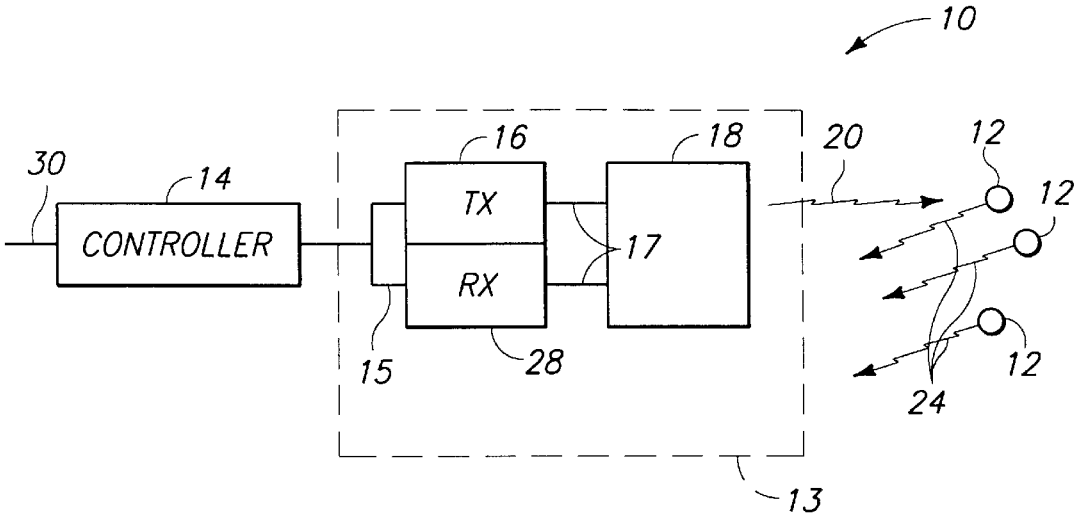
Fig 1 PRIOR ART
FIG. 1 is a simplified block diagram of a system for interrogating one or more radio frequency transponding modules, in accordance with the prior art.
Figure 2:
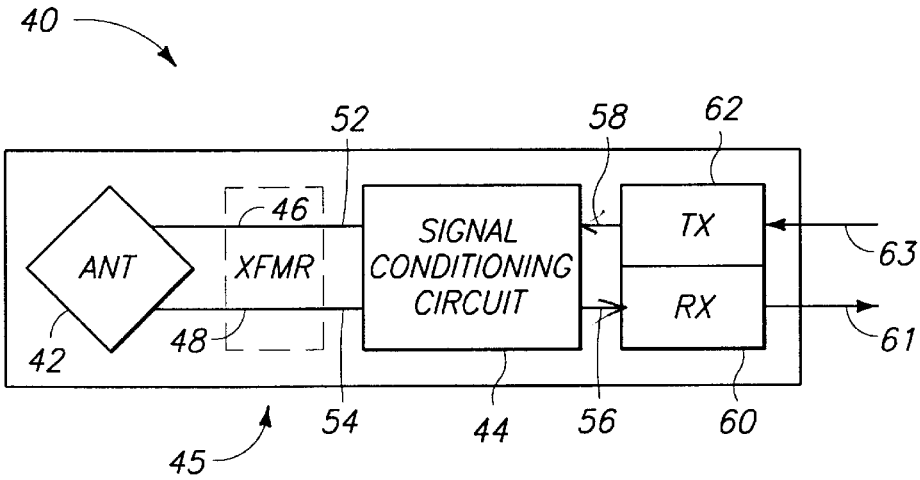
FIG. 2 is a simplified schematic diagram of a radio frequency module, in accordance with an embodiment of the present invention.

FIG. 2 is a simplified schematic diagram of a radio frequency module 40 including an antenna 42, in accordance with an embodiment of the present invention. In one embodiment, the radio frequency module 40 may be used to form the antenna module 18 of FIG. 1. In one embodiment, the radio frequency module 40 may be employed in the transponding modules 12. In one embodiment, the antenna 42 is a patch antenna. In one embodiment, the antenna 42 is capable of transmitting and receiving radio waves having rotational polarizations.

The antenna 42 is coupled to signal conditioning circuit through an impedance transformation circuit XFMR 45 including interconnections 46 and 48. In one embodiment, the interconnections 46 and 48 are transmission lines that also form the impedance transformation circuit XFMR 45 for impedance matching the antenna 42 to the signal conditioning circuit 44. The signal conditioning circuit 44 includes first through fourth ports 52, 54, 56 and 58.

In one embodiment, the interconnections 46 and 48 each form a quarter-wavelength transmission line impedance transformer. A characteristic impedance of the transmission lines forming the interconnections 46 and 48 is chosen to be a geometric mean of a characteristic impedance of the antenna 42 and characteristic impedances of first 52 and second 54 ports of the signal conditioning circuit 44.

When the antenna 42 is formed as a patch antenna and the transmission lines 46 and 48 each connect midway along a side of the antenna 42, the antenna 42 presents a characteristic impedance of about 120 ohms. Typically, the first 52 and second 54 ports are designed to have a characteristic impedance of 50 ohms, although other values may be chosen. Interconnections 46 and 48 formed to have a characteristic impedance of about 77 ohms and an electrical length of one-fourth of a wavelength provide impedance matching of the antenna 42 to the first 52 and second 54 ports.

The radio frequency module 40 also optionally includes a receiver RX 60 having an output 61 and a transmitter TX 62 having an input 63. The output 61 and input 63 may correspond, for example, to the interconnections 15 of FIG. 1, or may be coupled to a processor (not shown) in one of the transponding modules 12.

Third (output) and fourth (input) ports 56 and 58 of the signal conditioning circuit 44 are respectively coupled to and optionally impedance matched to the receiver RX 60 and to the transmitter TX 62. In one embodiment, the receiver RX 60 corresponds to the receiver RX 28 of FIG. 1, and the transmitter TX 62 corresponds to the transmitter TX 16.

The signal conditioning circuit 44 acts to selectively couple first RF signals coming from the antenna 42 in response to first radio waves having a first polarization, which may be rotational, to the receiver RX 60. The signal conditioning circuit 44 also acts to couple second signals from the transmitter TX 62 to the antenna 42 to generate second radio waves having a second rotational polarization (e.g., to provide the interrogation signal 20) but not couple these signals to the output port 56 or the receiver RX 60, even though the first and second signals are in a common frequency band.

In one embodiment, use of rotational polarization of the antenna 42 for one or more of the interrogation signal 20 and the response signal 24 allows the combination of the antenna 42 and the signal conditioning circuit 44 to separate the interrogation 20 and response 24 signals when the antenna 42 interacting with the interrogation signal 20 and the response signal 24 uses different chiralities of rotational polarization that are orthogonal for radio waves corresponding to these two signals 20 and 24.

In other words, when the signal conditioning circuit 44 results in interrogation signals 20 that are polarized in one rotational sense in response to a signal input at the input port 58, and the signal conditioning circuit 44 is impedance matched at all four ports 52, 54, 56, 58, the input port 58 is coupled to the antenna 42 but not to the output port 56. The receiver RX 60 and the transmitter TX 62 are then isolated from each other and may both be coupled to the antenna 42 such that both may be operating in a common frequency band using the same antenna 42 at the same time without significant mutual interference.

In one embodiment, the interrogation signal 20 has a first rotational polarization. The transponding module 12 includes a linearly polarized antenna (not illustrated). As a result, signals induced in the transponding module 12 are not amplitude optimized. In other words, a linearly polarized antenna is capable of receiving a circularly polarized signal but does not develop as much received power as a similarly situated and appropriately circularly polarized antenna could develop from the circularly polarized signal. Similarly, the linearly polarized antenna transmits a linearly polarized response signal 24. The linearly polarized response signal 24 can be received by an antenna 42 and signal conditioning circuit 44 configured to be optimized for reception of signals having a second rotational polarization and to reject signals having the first rotational polarization. As a result, the response signal 24 can be detected without substantial interference from the interrogation signal 20, even though they may be associated with antennae 42 that are very close together or that are a single antenna 42.

Figure 3:
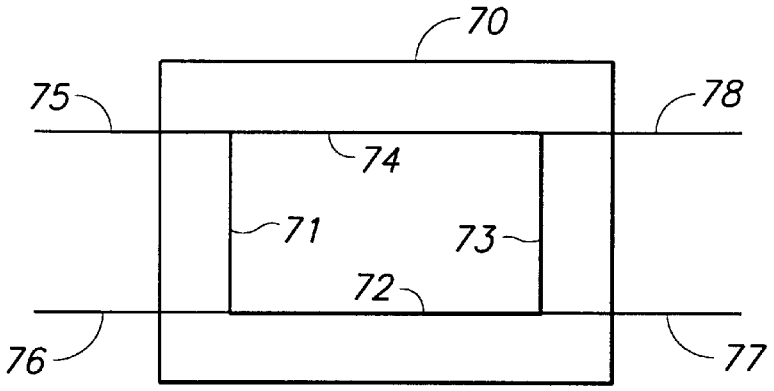
FIG 3 PRIOR ART
FIG. 3 is a simplified schematic diagram of a quadrature hybrid coupler, in accordance with the prior art.

FIG. 3 is a simplified schematic diagram of a quadrature hybrid coupler 70, in accordance with the prior art. The quadrature hybrid coupler 70 may be useful for realizing the signal conditioning circuit 44 of FIG. 2. The quadrature hybrid coupler 70 typically comprises four transmission lines 71, 72, 73, 74, each coupled between a pair of adjacent signal ports 75, 76, 77, 78 (analogous to the ports 52, 54, 56, 58 of FIG. 2).

Impedances and electrical lengths of the interconnecting transmission lines 71, 72, 73, 74 are chosen such that a signal input at one port (e.g., 75) results in two signals having a relative phase shift of 90° at two other ports (e.g., 77, 78) and no signal at the remaining port (e.g., 76), due to destructive interference effects.

In one embodiment, the antenna 42, the signal conditioning circuit 44 and the impedance transformation circuit XFMR 45 are realized as microstrip transmission lines formed on a common substrate, which may be formed of rigid materials such as conventional FR-4 or G-10 fiberglass/epoxy circuit board material. Stripline transmission lines and other forms of planar or non-planar transmission lines may be used as well. In another embodiment, flexible circuit board materials (e.g., Duroid, polyimide and the like) may be employed for one or more of the antenna 42, the signal conditioning circuit 44 and the impedance transformation circuit XFMR 45. Printed circuit realizations of the antenna 42, the signal conditioning circuit 44 and the impedance transformation circuit XFMR 45 can be readily mass produced to tight tolerances without requiring hand adjustment in order to optimize performance.

In another embodiment, the signal conditioning circuit 44 and/or the impedance transformation circuit XFMR 45 may be realized as lumped-element circuits that may or may not be formed on a circuit board with other elements of the antenna system 18, the transponding modules 12 (both of FIG. 1) or the radio frequency module 40 (FIG. 2).

Figure 4:
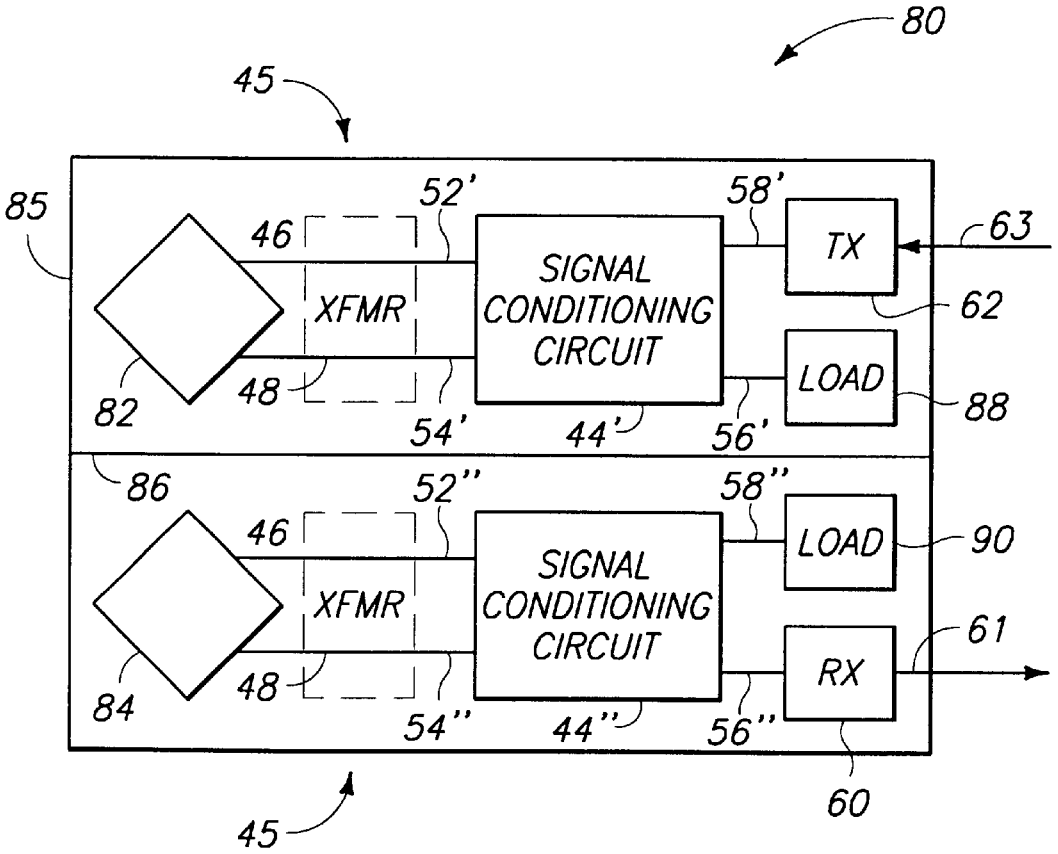
FIG. 4 is a simplified schematic diagram of a radio frequency module, in accordance with an embodiment of the present invention.

FIG. 4 is a simplified schematic diagram of a radio frequency module 80, in accordance with an embodiment of the present invention. The radio frequency module 80 is similar to the radio frequency module 40 of FIG. 2, but includes two antennas 82 and 84 in close proximity to each other. In one embodiment, the antennas 82 and 84 are formed on a common substrate 85. In one embodiment, the antennas 82 and 84 are formed on separate substrates (divided as represented by dividing line 86) but are physically near one another. In one embodiment, the antennas 82 and 84 are patch antennas.

Some of the elements shown in FIG. 4 are similar to elements shown in other figures. In the interest of brevity and clarity of explanation, these elements are given the same reference numerals and an explanation of them will not be repeated.

The transmitter TX 62 is coupled to an input port 58' to a signal conditioning circuit 44'. The antenna 82 is coupled to the transmitter TX 62 via first and second ports 52' and 54' of the signal conditioning circuit 44'. A load 88 is coupled to a third port 56'. The load 88 is optionally impedance matched to the third port 56' of the signal conditioning circuit 44'. Similarly, the antenna 84 is coupled to the receiver RX 60 through a signal conditioning circuit 44" via first and second ports 52" and 54" and an output port 56". A load 90 is coupled and optionally impedance matched to a fourth port 58".

The radio frequency module 80 may be employed in the interrogator 13 of FIG. 1, in the transponding modules 12 or in both, depending on requirements for the system 10. When the radio frequency module 80 or the radio frequency module 40 (FIG. 2) is employed in the interrogator 13, the problems associated with reflections of the interrogation signal 20 that may occur due to relative placement of transmit and receive antennas, as discussed above, are avoided. When the radio frequency module 40 or the radio frequency module 80 is employed in both the interrogator 13 and the transponding modules 12, higher signal-to-noise ratios are possible for the system 10. When the first 82 and second 84 antennas employ orthogonal polarizations, crosstalk between the transmitter TX 62 and the receiver RX 60 can be reduced.

The foregoing detailed description of the instant invention for the purposes of explanation have been particularly directed toward operation of RF identification tags. It will be appreciated that the invention is equally useful in inventory management systems and the like.

It will be appreciated that need for compact T/R antenna systems providing isolation between input and output signals in a common frequency band has been described along with methods for meeting that need. A novel antenna and signal conditioning system has been described that finds application in transponder systems.

Various changes and modifications to the embodiment herein chosen for purposes of illustration will readily occur to those skilled in the art. For example, the power level transmitted from the transponding modules may be chosen as may be desired for a specific application. To the extent that such modifications and variations do not depart from the spirit of the invention, they are intended to be included within the scope thereof which is assessed only by a fair interpretation of the following claims.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An antenna circuit comprising:

an antenna capable of coupling to radio waves having rotational polarization in a frequency band;

a signal transmission path having a first end coupled to the antenna; and a signal conditioning circuit having first and second ports coupled to a second end of the signal transmission path, the signal conditioning circuit coupling first signals in the frequency band to an output port of the signal conditioning circuit in response to first radio waves received by the antenna having a first polarization and coupling second signals in the frequency band from an input port of the signal conditioning circuit to the antenna to radiate second radio waves having a second, rotational polarization different than the first polarization, wherein the signal transmission path comprises two quarter-wavelength transmission lines acting as impedance transformers and the signal transmission path includes a first pair of ends coupled to the antenna and a second pair of ends coupled to the signal conditioning circuit.

2. The antenna circuit of claim 1 wherein the antenna comprises a patch antenna.

3. The antenna circuit of claim 1 wherein the first polarization comprises right hand circular polarization and the second, rotational polarization comprises left hand circular polarization or vice versa.

4. The antenna circuit of claim 1 wherein the first and second, rotational polarizations are orthogonal.

5. The antenna circuit of claim 1 wherein the signal conditioning circuit comprises a quadrature hybrid coupler.

6. An antenna circuit comprising:

a patch antenna capable of coupling to radio waves having right or left hand circular polarization in a frequency band;

a pair of quarter-wavelength transmission lines, a first line of the pair having a first end coupled to a first edge of the patch antenna and a second line of the pair having a first end coupled to a second edge of the patch antenna adjacent the first edge; and a quadrature hybrid coupler having a first port coupled to a second end of the first line and a second port, adjacent the first port, coupled to a second end of the second line, the quadrature hybrid coupler providing an output signal at an output port in response to first radio waves in the frequency band impinging on the patch antenna with a first polarization and causing the patch antenna to radiate second radio waves having a second, circular polarization different than the first polarization when an input signal in the frequency band is coupled to an input port of the quadrature hybrid coupler, a phase shift of ninety degrees existing between any pair of adjacent ports of the quadrature hybrid coupler.

7. The antenna circuit of claim 6 wherein the pair of quarter wavelength transmission lines comprises planar transmission lines.

8. The antenna circuit of claim 6 wherein the patch antenna, the pair of quarter-wavelength transmission lines and the quadrature hybrid coupler are formed on a common substrate.

9. The antenna circuit of claim 6 wherein the first and second circular polarizations are orthogonal.

10. A system for remotely polling one or more objects comprising:

at least one transponding module associated with a corresponding object; and an interrogator including a transmitter for transmitting an interrogation signal having a first rotational polarization and a receiver for receiving a response signal having a second polarization, the interrogator including:

an antenna configured to couple to the interrogation and response signals;

a signal conditioning circuit having first and second ports coupled to the antenna;

a receiver coupled to an output port of the signal conditioning unit, the signal conditioning circuit coupling the response signal from the antenna to the receiver; and a transmitter coupled to an input port of the signal conditioning unit, the signal conditioning circuit coupling the interrogation signal from the transmitter to the antenna but not the receiver to transmit the interrogation signal.

11. The system of claim 10 wherein the antenna comprises a patch antenna.

12. The system of claim 10 wherein the first rotational polarization comprises right hand circular polarization and the second polarization comprises left hand circular polarization or vice versa.

13. The system of claim 10 wherein the first and second polarizations are orthogonal.

14. The system of claim 10 wherein signal conditioning circuit comprises a quadrature hybrid coupler.

15. The system of claim 10 further comprising a signal transmission path having two transmission lines including a first pair of ends coupled to the antenna and a second pair of ends coupled to the first and second ports of the signal conditioning circuit.

16. The system of claim 15 wherein the signal transmission path comprises a quarter-wavelength impedance transformer having a first pair of ends coupled to the antenna and a second pair of ends each coupled to one of the first and second ports, respectively, of the signal conditioning circuit.

17. An antenna system comprising:

an antenna for providing a response signal from a response radio wave having a first polarization in a frequency band;

means for coupling the response signal to an output port; and means for coupling an interrogation signal in the frequency band to an input to the antenna to provide a transmitted radio wave having a second, rotational polarization different than the first polarization and not coupling the interrogation signal to the output port.

18. The antenna system of claim 17 further comprising:

means for coupling the response signal to a receiver; and means for coupling the interrogation signal from a transmitter to the antenna.

19. The antenna system of claim 18 wherein the means for coupling the response signal comprises means for coupling the response signal but not the interrogation signal to the receiver.

20. The antenna system of claim 17 wherein the means for coupling an interrogation signal comprises means for coupling an interrogation signal to the input to the antenna to provide a circularly polarized radio wave.

21. The antenna system of claim 17 wherein the means for coupling a response signal comprises means for coupling a response signal to the output port in response to a polarized radio wave received by the antenna.

22. The antenna system of claim 21 wherein means for coupling a response signal comprises means for coupling a response signal from a circularly polarized radio wave having a chirality opposite that of the radio wave provided from the interrogation signal to the output port.

23. A method of coupling signals between an interrogation unit and a transponding module comprising:

transmitting a first signal from the interrogation unit, the first signal including one radio wave in a frequency band having a first rotational polarization;

receiving a linearly polarized component of the first signal in the transponding module;

transmitting a linearly polarized signal in the frequency band from the transponding module; and receiving another radio wave including a rotationally polarized component of the linearly polarized signal at the interrogation unit, the rotationally polarized component having a second rotational polarization that is different from the first rotational polarization.

24. The method of claim 23, wherein the interrogation unit includes a receiver, the method further coupling the signals from the another radio wave but not the one radio wave to the receiver.

25. The method of claim 24 further comprising:

coupling signals from the another radio wave but not from the one radio wave to a receiver through a signal conditioning circuit; and coupling signals from a transmitter to the antenna through the signal conditioning circuit to provide the one radio wave.

26. The method of claim 24 herein receiving another radio wave comprises receiving a response signal.

27. The method of claim 24 wherein transmitting the one radio wave comprises transmitting a circularly polarized interrogation signal.

28. An antenna circuit comprising:

an antenna capable of coupling to radio waves having rotational polarization in a frequency band;

a signal transmission path having a first end coupled to the antenna; and a signal conditioning circuit having first and second ports coupled to a second end of the signal transmission path, the signal conditioning circuit coupling first signals in the frequency band to an output port of the signal conditioning circuit in response to data included in first radio waves received by the antenna having a first polarization and coupling second signals in the frequency band from an input port of the signal conditioning circuit to the antenna to radiate second radio waves having a second, rotational polarization different than the first polarization.

29. The antenna circuit of claim 28 wherein the antenna comprises a patch antenna.

30. The antenna circuit of claim 28 wherein the first polarization comprises right hand circular polarization and the second, rotational polarization comprises left hand circular polarization or vice versa.

31. The antenna circuit of claim 28 wherein the first and second, rotational polarizations are orthogonal.

32. The antenna circuit of claim 28 wherein the signal conditioning circuit comprises a quadrature hybrid coupler.

33. The antenna circuit of claim 28 wherein the signal transmission path comprises two quarter-wavelength transmission lines acting as impedance transformers and the signal transmission path includes a first pair of ends coupled to the antenna and a second pair of ends coupled to the signal conditioning circuit.

* * * * *

UNITED STATES PATENT AND TRADEMARK OFFICE

CERTIFICATE OF CORRECTION

PATENT NO. : 6,255,993 B1
DATED : July 3, 2001
INVENTOR(S) : Roy Greef et al.

It is certified that error appears in the above-identified patent and that said Letters Patent is hereby corrected as shown below:

Column 11, claim 26,
Line 12, delete "herein" and insert -- wherein --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*